US009750303B2

(12) United States Patent
Bjornson et al.

(10) Patent No.: US 9,750,303 B2
(45) Date of Patent: Sep. 5, 2017

(54) CAMBERED SOLE

(71) Applicant: New Balance Athletics, Inc., Boston, MA (US)

(72) Inventors: Andrew A. Bjornson, West Newbury, MA (US); Marya Lourdes Chan, Boston, MA (US); Patrick Y. Choe, Medford, MA (US); Bernard Jankowski, Danville, NH (US); Sean B. Murphy, North Andover, MA (US)

(73) Assignee: New Balance Athletics, Inc., Boston, MA (US)

( * ) Notice: Subject to any disclaimer, the term of this patent is extended or adjusted under 35 U.S.C. 154(b) by 367 days.

(21) Appl. No.: 14/211,648

(22) Filed: Mar. 14, 2014

(65) Prior Publication Data

US 2014/0259769 A1 Sep. 18, 2014

Related U.S. Application Data

(60) Provisional application No. 61/792,691, filed on Mar. 15, 2013.

(51) Int. Cl.
*A43B 13/14* (2006.01)
*A43B 7/14* (2006.01)

(52) U.S. Cl.
CPC ..... *A43B 7/142* (2013.01); *A43B 7/143* (2013.01); *A43B 7/1495* (2013.01); *A43B 13/14* (2013.01); *A43B 13/141* (2013.01)

(58) Field of Classification Search
CPC ..... A43B 13/00; A43B 13/14; A43B 13/141; A43B 13/16; A43B 7/1495
USPC ..... 36/25 R, 31, 102
See application file for complete search history.

(56) References Cited

U.S. PATENT DOCUMENTS

| | | | | |
|---|---|---|---|---|
| 1,959,050 A | | 5/1934 | Closson | |
| 1,962,527 A | | 6/1934 | Ringle | |
| 1,971,108 A | | 8/1934 | Karow | |
| 4,399,621 A | | 8/1983 | Dassler | |
| 4,546,556 A | | 10/1985 | Stubblefield | |
| 4,550,510 A | | 11/1985 | Stubblefield | |
| 4,785,557 A | * | 11/1988 | Kelley | A43B 13/12 36/30 R |

(Continued)

FOREIGN PATENT DOCUMENTS

| | | |
|---|---|---|
| EP | 0838169 A2 | 4/1998 |
| JP | 2000-139508 A | 5/2000 |

(Continued)

OTHER PUBLICATIONS

"Buy Mens Puma Mobium Running Shoe at Road Runner Sports", Feb. 21, 2013, pp. 1-2, http://www.roadrunnersports.com/rrs/products/PMA482/.

*Primary Examiner* — Marie Bays
(74) *Attorney, Agent, or Firm* — Goodwin Procter LLP

(57) ABSTRACT

The invention relates to shoes including sole elements having a cambered profile. An example sole element includes a midsole having a heel portion, a midfoot portion, and a forefoot portion, the midfoot portion including a longitudinal arch including a medial longitudinal arch portion and a lateral longitudinal arch portion, wherein the longitudinal arch is at least partially elevated above a ground surface in an unloaded condition and deforms towards a ground surface and elongates longitudinally in a loaded condition.

19 Claims, 9 Drawing Sheets

(56) References Cited

U.S. PATENT DOCUMENTS 4,868,945 A 9/1989 DeBettignies
5,129,395 A 7/1992 Hoffmann
5,311,680 A 5/1994 Comparetto
5,359,791 A 11/1994 Prahl et al.
5,440,826 A * 8/1995 Whatley ..... A43B 13/181 36/25 R
5,528,842 A 6/1996 Ricci et al.
5,718,013 A 2/1998 Gumbert
6,021,588 A 2/2000 Alviso
6,032,388 A 3/2000 Fram
6,065,230 A * 5/2000 James ..... A43B 3/0057 36/25 R
6,189,239 B1 2/2001 Gasparovic et al.
6,321,469 B1 11/2001 Cretinon
6,412,196 B1 * 7/2002 Gross ..... A43B 13/026 36/102
6,557,273 B2 5/2003 Polifroni
6,634,121 B2 10/2003 Sordi
6,665,956 B2 12/2003 Hay
6,763,615 B2 7/2004 Mitsui et al.
6,836,979 B2 1/2005 Flavio et al.
6,886,276 B2 5/2005 Hlavac
6,915,598 B2 7/2005 Grisoni et al.
7,243,445 B2 * 7/2007 Manz ..... A43B 3/0036 36/103
7,249,426 B2 7/2007 Romano et al.
7,392,605 B2 * 7/2008 Hatfield ..... A43B 3/0057 36/102
7,418,791 B2 * 9/2008 Cole, III ..... A43B 7/1415 36/25 R
7,430,817 B2 * 10/2008 Abadjian ..... A43B 5/00 36/102
7,444,763 B2 * 11/2008 Grove ..... A43B 13/223 36/100
7,444,767 B2 * 11/2008 Kilgore ..... A43B 7/144 36/28
7,946,058 B2 * 5/2011 Johnson ..... A43B 3/0057 36/102
8,074,377 B2 * 12/2011 Nishiwaki ..... A43B 7/142 36/25 R
8,418,379 B2 * 4/2013 Nishiwaki ..... A43B 7/142 36/25 R
8,505,220 B2 * 8/2013 James ..... A43B 13/141 36/102
8,578,629 B2 * 11/2013 Bosomworth ..... A43B 13/10 36/102
8,646,191 B2 * 2/2014 Amos ..... A43B 7/1425 36/103
8,656,613 B2 * 2/2014 Stockbridge ..... A43B 13/00 36/102
8,707,587 B2 * 4/2014 Christensen ..... A43B 3/0057 36/102
8,752,307 B2 * 6/2014 Cooper ..... A43B 1/0072 36/102
2005/0241187 A1 * 11/2005 Johnson ..... A43B 3/0063 36/103
2006/0137228 A1 * 6/2006 Kubo ..... A43B 3/0036 36/103
2006/0288611 A1 * 12/2006 Hogan ..... A43B 13/16 36/25 R
2007/0107264 A1 * 5/2007 Meschter ..... A43B 5/12 36/76 R
2008/0216355 A1 * 9/2008 Becker ..... A43B 13/026 36/102
2009/0113758 A1 * 5/2009 Nishiwaki ..... A43B 13/10 36/88
2010/0313447 A1 * 12/2010 Becker ..... A43B 13/026 36/102
2011/0197468 A1 8/2011 Kubo et al.
2011/0214313 A1 * 9/2011 James ..... A43B 13/141 36/103
2011/0239489 A1 * 10/2011 Iuchi ..... A43B 13/12 36/30 R
2011/0247243 A1 * 10/2011 Eder ..... A43B 13/26 36/67 A
2011/0296709 A1 * 12/2011 Fuerst ..... A43B 1/14 36/11.5
2012/0260534 A1 * 10/2012 Guer ..... A43B 5/02 36/134
2013/0232821 A1 * 9/2013 Schindler ..... A43B 13/181 36/103
2014/0013623 A1 * 1/2014 James ..... A43B 13/141 36/102
2014/0223778 A1 * 8/2014 Horacek ..... A43B 3/0036 36/102
2014/0250729 A1 * 9/2014 James ..... A43B 13/141 36/102
2014/0283413 A1 * 9/2014 Christensen ..... A43B 3/0057 36/102
2015/0250260 A1 * 9/2015 Bessho ..... A43B 13/122 36/25 R
2016/0000182 A1 * 1/2016 James ..... A43B 13/141 36/102

FOREIGN PATENT DOCUMENTS

JP 2003-019004 A 1/2003
WO WO-2012084147 A1 6/2012
WO WO-2013131533 A1 9/2013

* cited by examiner

CAMBERED SOLE

CROSS-REFERENCE TO RELATED APPLICATIONS

This application claims priority to and the benefit of U.S. Provisional Patent Application Ser. No. 61/792,691, filed Mar. 15, 2013, the disclosure of which is incorporated herein by reference in its entirety.

FIELD OF THE INVENTION

The present invention relates generally to the field of footwear, and more particularly to shoe soles, and components thereof, having a cambered profile.

BACKGROUND OF THE INVENTION

Traditional athletic footwear generally has a midsole that has substantial thickness in the heel and forefoot which does not allow the sole to conform to the wearers foot while it is flexed and torqued during the gait cycle. This has a negative impact on the fit of the shoe and does not allow the foot to flex and expand in the transverse and longitudinal planes. Minimal athletic footwear with thinner midsole profiles have been designed to try to accommodate this flexion and torsion and to allow the shoe to expand in the transverse and longitudinal planes, but is done at the sacrifice of the amount of material placed under the users foot. As a result, minimal-type products generally require very thin sole elements with very little support provided to the wearer.

SUMMARY OF THE INVENTION

As a result, there is a need for an improved shoe for an article of footwear that provides a more conforming, adaptive flexion during loading and unloading of the foot to assist in the prevention of injury and to improve the efficiency of the athlete during a gait cycle while still providing adequate support, cushioning, and protection for the foot.

One aspect of the invention includes an article of footwear having an upper and a sole, the sole including a midsole having a heel portion, a midfoot portion, and a forefoot portion. The midfoot portion includes a substantially longitudinal arch including a medial longitudinal arch portion and a lateral longitudinal arch portion. The longitudinal arch is at least partially elevated above a ground surface in an unloaded condition and deforms towards a ground surface and elongates longitudinally in a loaded condition. In one embodiment the medial longitudinal arch portion extends to a greater height than the lateral longitudinal arch portion.

The forefoot portion may include a substantially transverse arch that is at least partially elevated above a ground surface in an unloaded condition and deforms towards a ground surface and elongates transversely in a loaded condition. The transverse arch may be positioned proximate the metatarsal region of the forefoot portion. In one embodiment the medial longitudinal arch portion and/or the lateral longitudinal arch portion extends to a greater height than the transverse arch.

In one embodiment the midsole includes a plurality of flex grooves on a lower surface thereof. One or more flex groove may extend in a substantially transverse direction and one or more flex groove may extend in a substantially longitudinal direction. The flex grooves may at least partially separate the lower surface of the midsole into a plurality of protruding elements. In one embodiment there are at least two protruding elements on a medial longitudinal arch portion and at least one protruding element on a lateral longitudinal arch portion. The article of footwear may further include a void between at least one protruding element on the medial longitudinal arch portion and at least one protruding element on the lateral longitudinal arch portion, wherein the void is wider than the flex grooves.

In one embodiment the article of footwear further includes at least one tension element in the longitudinal arch and/or in the forefoot region. Tension elements may extend in a substantially longitudinal direction, a substantially transverse direction, and/or at any angle therebetween. In one embodiment one or more tension element extends across at least one flex groove. The tension element(s) may be anchored substantially at the ends thereof to the midsole and, for example, to at least a portion of protruding elements proximate the flex groove over which the tension element(s) extend.

Another aspect of the invention includes a sole element for an article of footwear, the sole element including a midsole having a heel portion, a midfoot portion, and a forefoot portion. The midfoot portion includes a substantially longitudinal arch including a medial longitudinal arch portion and a lateral longitudinal arch portion. The longitudinal arch is at least partially elevated above a ground surface in an unloaded condition and deforms towards a ground surface and elongates longitudinally in a loaded condition.

Another aspect of the invention includes an article of footwear including an upper and a sole, the sole including a midsole having a heel portion, a midfoot portion, and a forefoot portion. In one embodiment the midfoot portion includes a substantially longitudinal arch including a medial longitudinal arch portion and a lateral longitudinal arch portion, wherein the longitudinal arch is at least partially elevated above a ground surface in an unloaded condition and deforms towards a ground surface and elongates longitudinally in a loaded condition.

In one embodiment the forefoot portion includes a substantially transverse arch that is at least partially elevated above a ground surface in an unloaded condition and deforms towards a ground surface and elongates transversely in a loaded condition. In one embodiment the midsole includes a plurality of flex grooves on a lower surface thereof, the flex grooves at least partially separating the lower surface of the midsole into a plurality of protruding elements. In one embodiment the sole further includes at least one tension element extending across at least one flex groove in the longitudinal arch region, the at least one tension element being anchored substantially at the ends thereof to the midsole and, for example, to at least a portion of protruding elements proximate the flex groove over which the tension element(s) extend.

Another aspect of the invention includes a method of supporting a foot during a gait cycle. The method includes providing an article of footwear including an upper and a sole. The sole includes a midsole including a heel portion, a midfoot portion, and a forefoot portion, the midfoot portion including a longitudinal arch region, wherein the longitudinal arch region is at least partially elevated above a ground surface in an unloaded condition and deforms towards a ground surface and elongates longitudinally in a loaded condition.

These and other objects, along with advantages and features of the present invention herein disclosed, will become more apparent through reference to the following description, the accompanying drawings, and the claims.

Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

The invention described herein relates to footwear, and more particularly to soles, and components thereof, providing a flexible cambered profile for at least a portion of the sole.

The sole components described herein may form an insole, midsole, and/or outsole of a shoe, or form a sole element for integration into an insole, midsole, and/or outsole of the shoe (e.g., through bonding to, and/or mechanical attachment to, another midsole element). The sole components can be manufactured from any appropriate method and system, as is known in the art. In one embodiment, for example, a sole, or a component therefor, can be manufactured from a polymeric material that is molded (e.g., expansion molded or compression molded) to form a finished part.

Polymeric material for use in the manufacture of the sole components may include, or consist essentially of, polymers, elastomers, thermoplastics, and/or thermosets. For example, the polymeric material may be ethylene vinyl acetate (EVA), EVA copolymers, polyethylene (PE), chlorinated polyethylene (CPE), polyurethane (PU), thermoplastic polyurethane (TPU), DuPont™ Surlyn®, blown rubber, or thermoplastic rubber (TPR). In one example embodiment the polymeric material is a ground-contact EVA (i.e., an EVA formulated specifically to provide appropriate performance, wear, and durability characteristics to allow it to be used as the ground-contacting surface of a shoe sole.

Figure 1A:
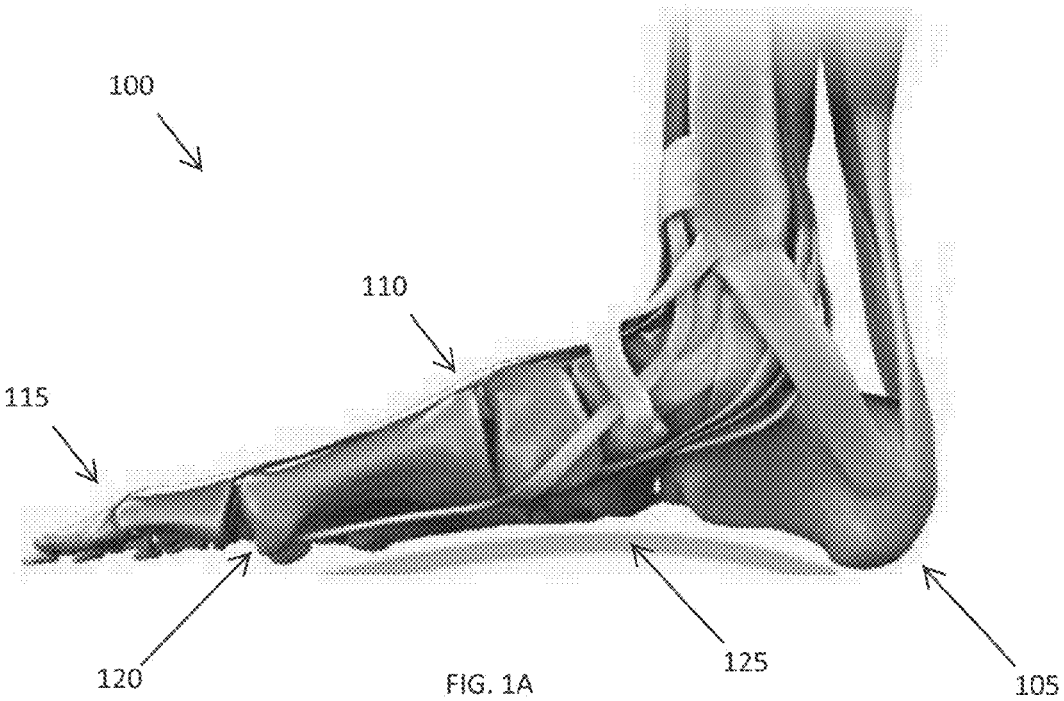
FIG. 1A is a side view of the bones and musculature of a foot in an unloaded configuration, in accordance with one embodiment of the invention.
Figure 1B:
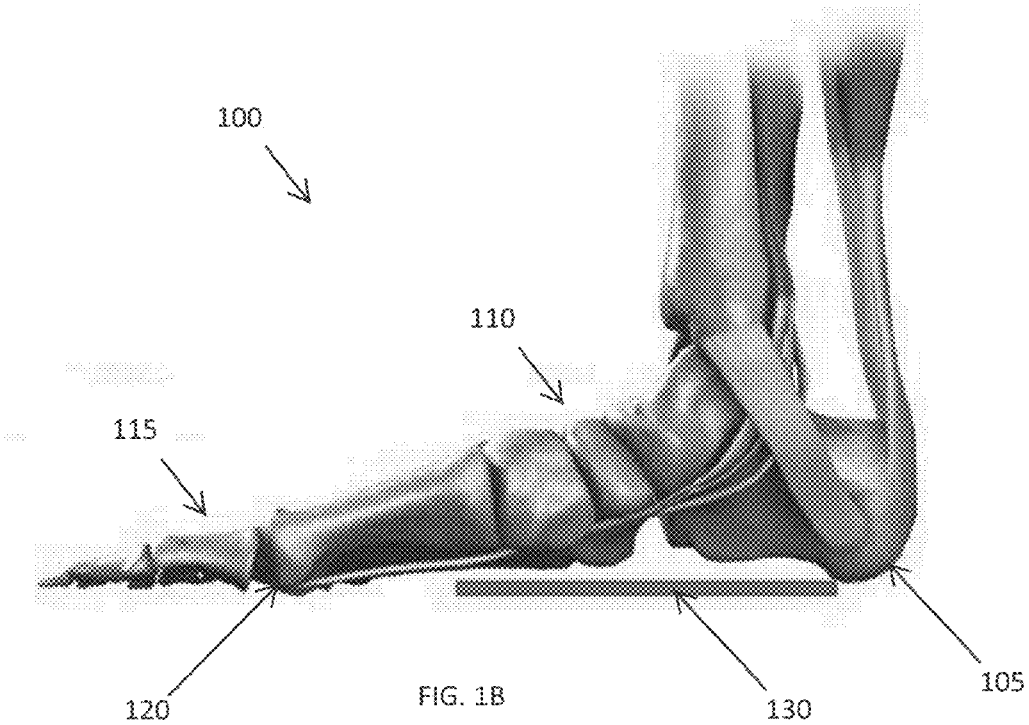
FIG. 1B is a side view of the foot of FIG. 1A in a loaded configuration.
Figure 2A:
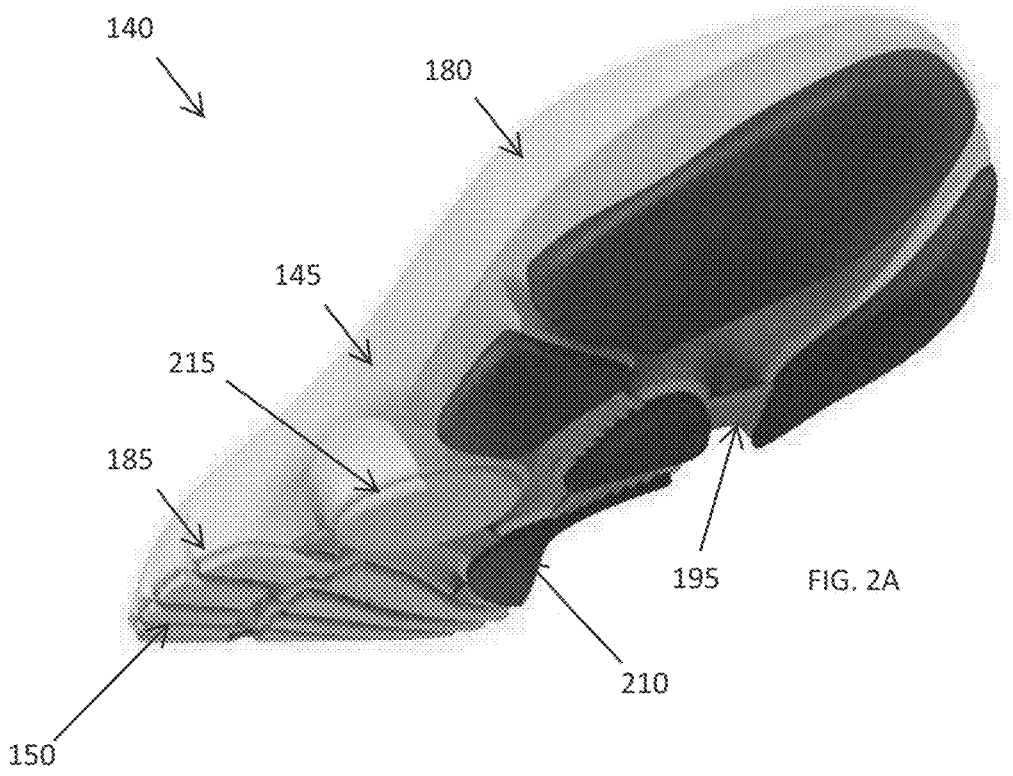
FIG. 2A is a first perspective view of a sole of an article of footwear having a plurality of tensioning elements embedded therein, in accordance with one embodiment of the invention.
Figure 2B:
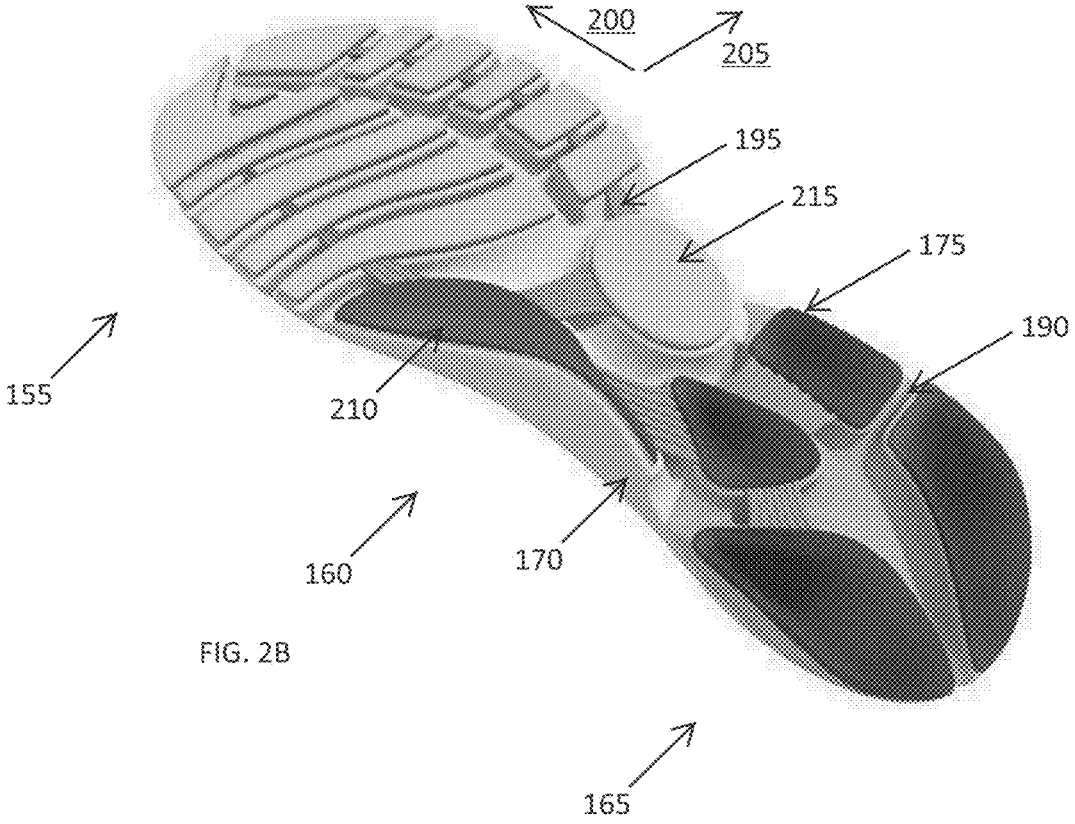
FIG. 2B is a second perspective view of the sole of FIG. 2A.
Figure 2C:
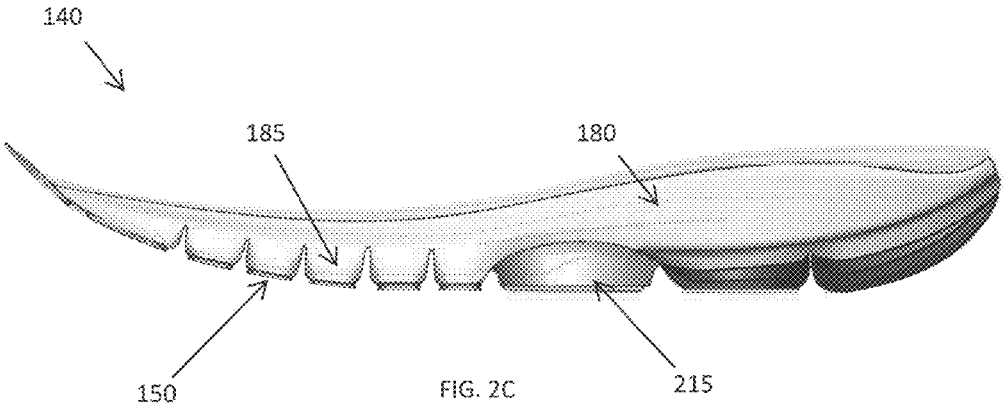
FIG. 2C is a side view of the sole of FIG. 2A.
Figure 2D:
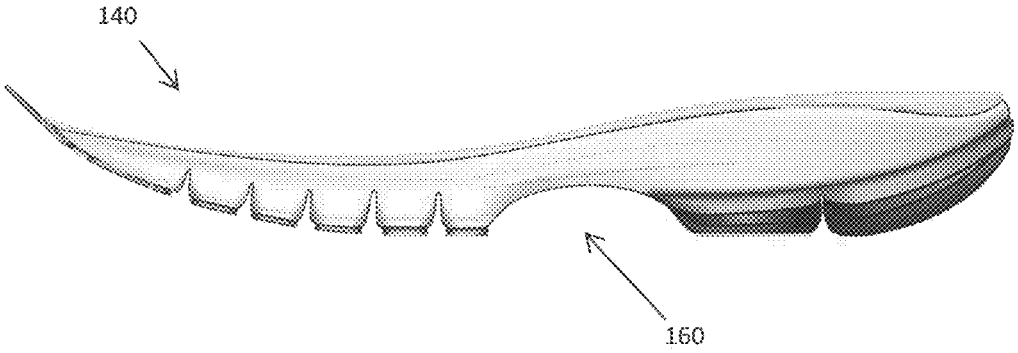
FIG. 2D is a side view of the sole of FIG. 2A without the lateral arch pod, in accordance with one embodiment of the invention.

FIG. 1A shows the bones and musculature of a foot 100 in an unloaded condition. The foot 100 includes a heel portion 105, a midfoot portion 110, and a forefoot portion 115, the forefoot portion containing the metatarsal heads 120. As shown, in an unloaded condition (i.e., without the weight of the individual pressing down on the foot 100 and forcing the foot against a ground surface), the midfoot portion 110 of the foot 100 includes an arch having a defined curvature 125, wherein at least a portion of the midfoot region 110 is at least partially elevated above a ground surface. The shape and extent of this curvature will depend upon the specific geometry and physical characteristics of each individual foot. As can be seen in FIG. 1B, which shows the same foot 100 in a loaded condition (i.e., with the weight of the individual pressing down on the foot 100 and forcing the foot against a ground surface), the midfoot region 110 is pressed down when loaded to produce an arch having a substantially flat, or at least significantly reduced, curvature 130. This reduction in the curvature of the arch has the effect of elongating the foot in the longitudinal direction. Similarly, the forefoot region, and more particularly the region of the forefoot at and around the metatarsal heads, has a transverse arch in an unloaded condition, with this transverse arch deforming and elongating in the transverse direction during loading.

An example sole for an athletic shoe including a highly flexible structure with a defined arch region (i.e., an upwardly curved region having lower side portions and a raised central portion) and a plurality of tensioning elements is shown in FIGS. 2A through 2D. In this embodiment, the sole 140 includes a midsole 145 and a plurality of outsole elements 150 e.g., ground contact rubber outsole pods). The sole 140 includes a forefoot region 155, a midfoot region 160, and a heel region 165, and has a medial side 170 and a lateral side 175. The midsole can include a base portion 180 with a plurality of protruding elements 185 (i.e., discrete downward facing extensions defined by the flex grooves 190) extending down therefrom, with the outsole elements 150 positioned on the distal ends of the protruding elements 185. The protruding elements 185 may be divided by flex grooves 190, which can be molded into the midsole 145 during manufacture or be siped or otherwise cut into the midsole 145. In various embodiments the grooves 190 can be of any appropriate depth and be positioned and shaped in any appropriate manner throughout the sole 140 to produce the required degree and configuration of flexibility.

The sole 140 further includes a plurality of tensioning elements 195 (e.g., elastic elements such as rubber bands) positioned within the midsole 145 or outsole 150, or held between the midsole 145 and outsole 150. In one embodiment one or more outsole elements 150 may be shaped and configured to act as tensioning elements 195. In an alternative embodiment the tensioning elements 195 may be distinct from (i.e., made from a different material and/or structurally different from) the outsole 150 elements. The tensioning elements 195 can extend in a substantially longitudinal direction 200 or a substantially transverse direction 205, or extend at any other angle on the sole 140. In operation, the tensioning elements 195 are held in tension on the sole 140 and extend over grooves 190 between protruding elements 185 to provide an elastic tension counteracting a deflection of the sole 140 during loading and assisting in elastically returning the sole 140 to its unloaded shape. This may be particularly beneficial, for example, in embodiments including a cambered arch region, where the arch is adapted to undergo significant deflection during loading. Elastically returning the sole 140 to its cambered unloaded configuration can provide additional energy return during a footstrike event and also support the foot in a natural position throughout a gait cycle to minimize the risk of injury.

In one embodiment the tensioning elements 195 can be unloaded when the sole 140 is in an unloaded condition, and may only apply an elastic tensioning force upon deformation of the sole 140 (for example at the midfoot arch region and/or forefoot transverse arch region) during loading caused, for example, by a ground contacting footstrike. In another embodiment one or more tensioning elements 195 may be loaded even when the sole 140 is in an unloaded condition (e.g., when the sole is off the ground).

One embodiment of the invention includes a medial arch pod 210 and a lateral arch pod 215 to provide additional cushioning during a footstrike event. These pods may be made from any appropriate material and, for example, a deformable foam. In an alternative embodiment, as shown in FIG. 3, no arch pods are required, with the midfoot region 160 of the sole 140 free to deflect concurrently with the deflection of the midfoot of the foot of a wearer of the shoe during a groundstrike event.

Figure 3:
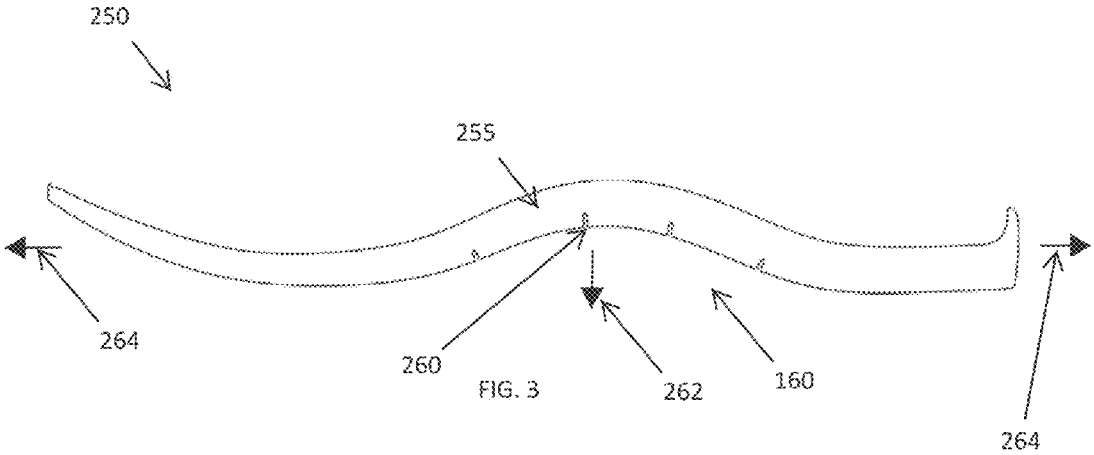
FIG. 3 is a side view of a sole for an article of footwear having a cambered longitudinal arch region, in accordance with one embodiment of the invention.

An example sole element 250 for a shoe including a highly cambered arch 255 in a midfoot region 160 is shown in FIG. 3. In this embodiment, the cambered arch 255 has a plurality of molded or siped grooves 260 separating the midsole 145 into a plurality of separate protruding elements 185 within the midfoot region 160 to provide flexibility to the cambered arch 255 and allow for deflection of the cambered arch 255 along with the deflection of a foot during loading of the foot during a groundstrike event. In various embodiments the cambered arch 255 can have any appropriate degree of camber necessary to mold to (or substantially mold to) and elastically support the arch region of the foot of a shoe wearer.

In operation, the cambered arch 255 may be adapted to conform substantially to the arch portion of a foot of a wearer of the shoe both when unloaded and upon loading of the sole element 250, for example during a footstrike event. As indicated in FIG. 3, upon loading the cambered arch 255 is pushed downwards 262 towards a ground surface by the splaying and deformation of the arch of a foot during footstrike. In addition, this downward force 262 has the effect of elongating the sole element 250 through longitudinal elongation 264 of the sole element 250 as the cambered arch 255 is pushed downwards 262 and flattened. This deformation of the shape of the sole element 250 during loading corresponds, or substantially corresponds, to the deformation and splaying of the foot during groundstrike, and therefore allows the sole element 250 to conformingly support the arch of a foot throughout an entire gait cycle. Such a configuration allows for the flexibility and conformal support of a minimal-type shoe while still allowing the sole to have the thickness and cushioning of a more traditional athletic shoe.

Figures 4A, 4B, 4C:
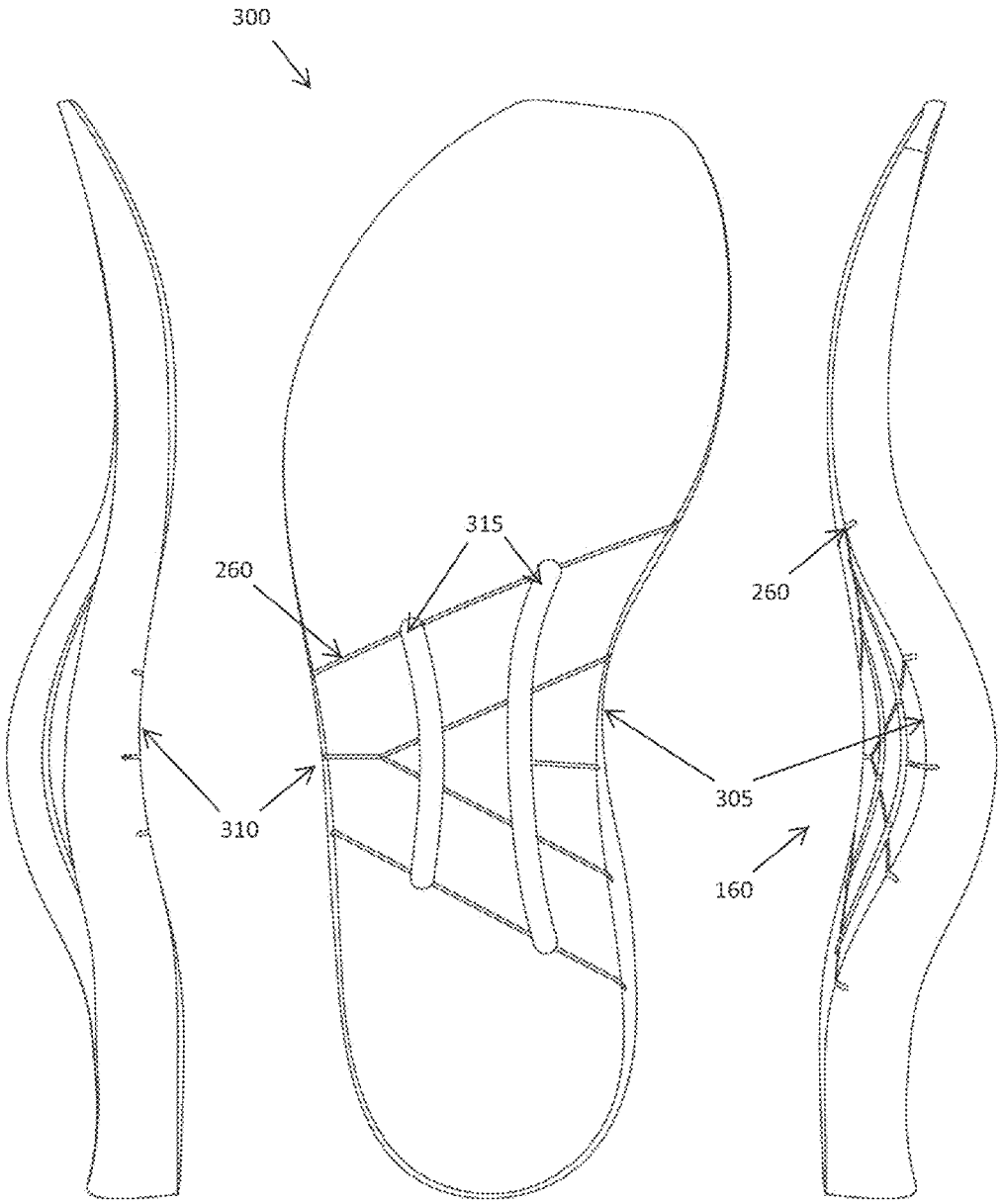
FIG. 4A is a bottom view of another sole for an article of footwear having a cambered longitudinal arch region, in accordance with one embodiment of the invention.
FIG. 4B is a lateral side view of the sole of FIG. 4A.
FIG. 4C is a medial side view of the sole of FIG. 4A.

In one embodiment the midfoot region 160 of a sole for an article of footwear can have a first longitudinal cambered arch in a medial side of the sole and a second, different, longitudinal cambered arch in a lateral side of the sole, with the intermediate region between the medial and lateral sides having a cambered arch that blends between the arch shapes on the medial and lateral sides in any appropriate manner (e.g., in a manner conforming at least substantially to the contour of the arch region of a foot). An example sole element 300 having a different medial longitudinal cambered arch 305 and lateral longitudinal cambered arch 310 is shown in FIGS. 4A to 4C. The bottom surface of the sole element 300 includes a plurality of a siped grooves 260 separating different portions of the midfoot arch region 160, and a plurality of elongate grooves, or voids 315, extending longitudinally through the midfoot arch region 160. The voids 315 can extend to any height within the sole element 300 and, in one embodiment, extend all the way through the sole element 300. The voids 315 provide additional flexibility and also reduce the weight of the sole element 300.

In this embodiment, the medial longitudinal cambered arch 305 extends to a greater height than the lateral longitudinal cambered arch 310, with the respective shapes of the arches configured to substantially conform to the shape of the unloaded arch region of a foot. In operation, the sole element 300 is adapted to be flexible enough such that, upon loading (e.g., upon the foot striking the ground during a walking or running gait) the midfoot arch region 160 of the sole element 300 conformingly flattens and splays (e.g., elongates in the longitudinal direction) along with the arch of the foot, with the arch springing back to its curved unloaded configuration upon the foot unloading (e.g., leaving the ground after the footstrike event).

Figures 5A, 5B, 5C:
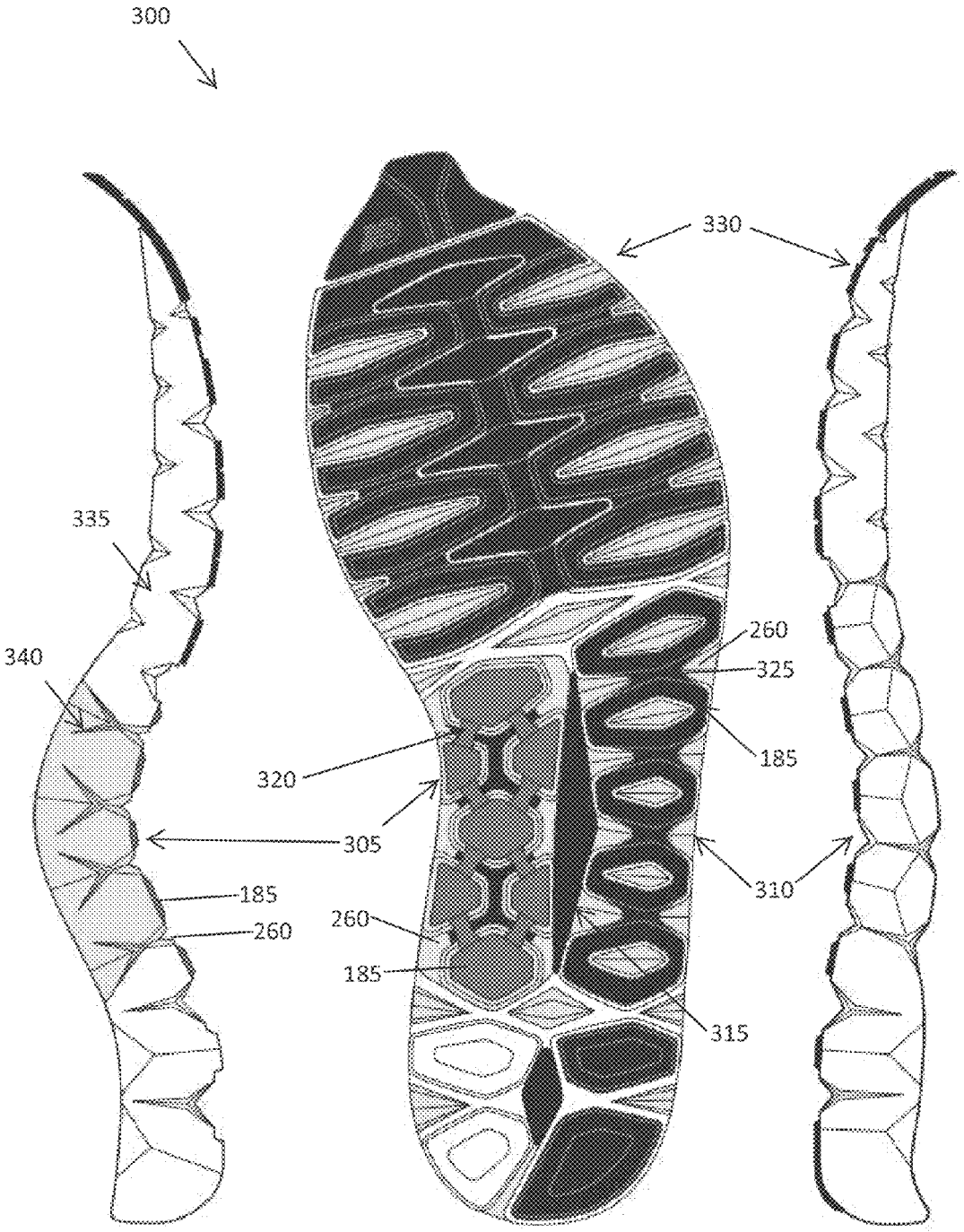
FIG. 5A is a bottom view of another sole for an article of footwear having a cambered longitudinal arch region, in accordance with one embodiment of the invention.
FIG. 5B is a medial side view of the sole of FIG. 5A.
FIG. 5C is a lateral side view of the sole of FIG. 5A.
Figures 6A, 6B, 6C:
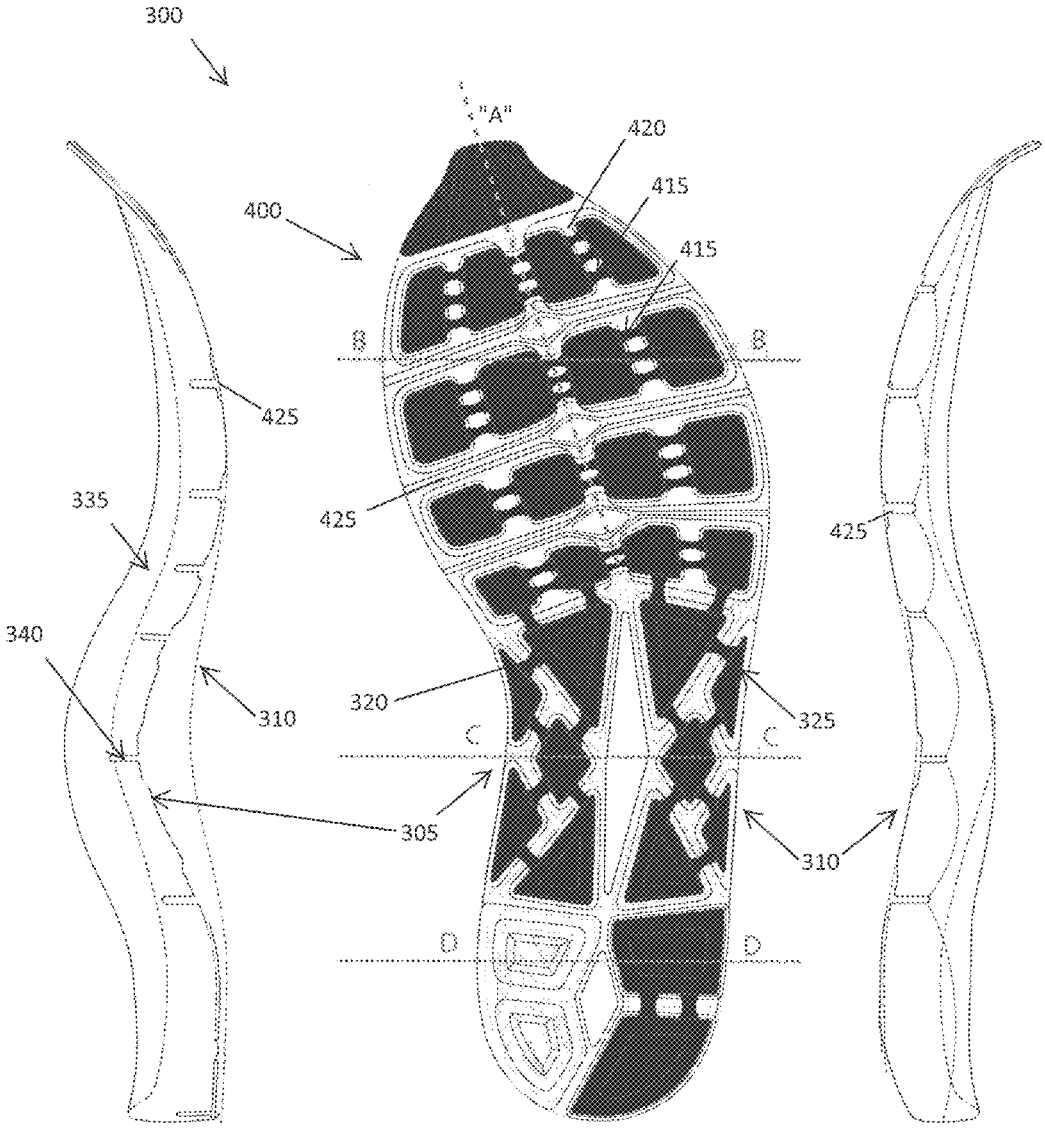
FIG. 6A is a bottom view of another sole for an article of footwear having a cambered longitudinal arch region, in accordance with one embodiment of the invention.
FIG. 6B is a medial side view of the sole of FIG. 6A.
FIG. 6C is a lateral side view of the sole of FIG. 6A.
Figure 6D:
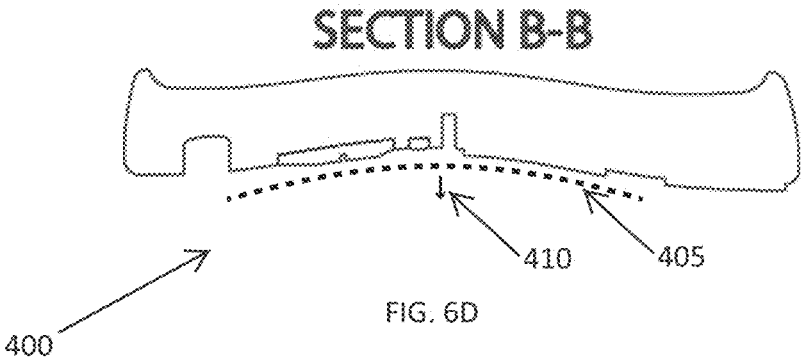
FIG. 6D is a cross-sectional view of the sole of FIG. 6A through section B-B.
Figure 6E:
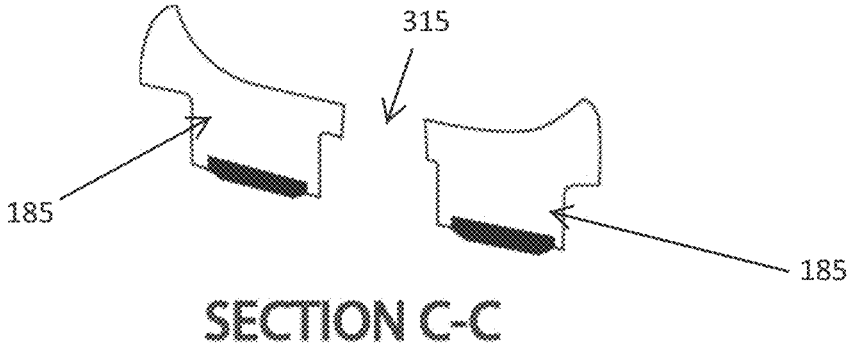
FIG. 6E is a cross-sectional view of the sole of FIG. 6A through section C-C.
Figure 6F:
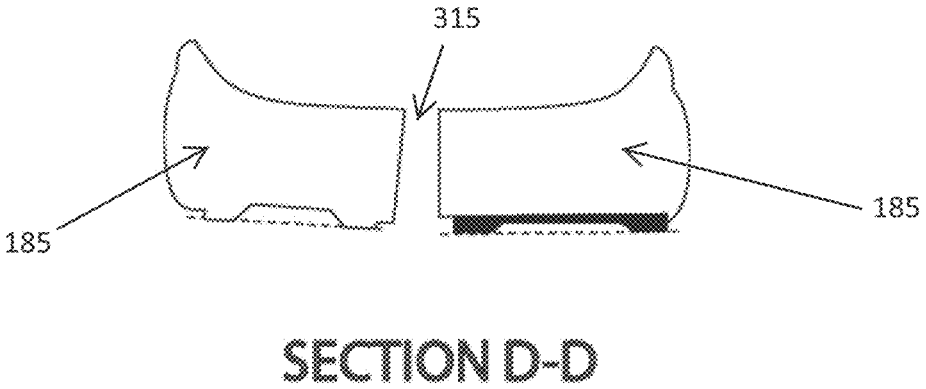
FIG. 6F is a cross-sectional view of the sole of FIG. 6A through section D-D.

In one embodiment the sole element 300 can include a number of elongate tensioning elements extending through deformable arch regions of the sole. An example sole element 300 having a medial longitudinal cambered arch 305 and a lesser curved lateral longitudinal cambered arch 310 with medial tensioning elements 320 and lateral tensioning elements 325 extending between protruding elements 185 and over grooves 260 spanning at least a portion of the midfoot arch region 160 is shown in FIGS. 5A to 5C. The medial tensioning elements 320 extend at an acute angle of between about 10°-40° from the longitudinal axis (i.e., the axis extending longitudinally from the back of the shoe to the front of the shoe) of the shoe, while the lateral tensioning elements 325 extend in a substantially longitudinal direction. In alternative embodiments various tensioning elements may extend at any appropriate angle between 0°-90° from the longitudinal axis, depending upon the specific arrangement of protruding elements 185 and grooves 260 and on the specific arch displacement being supported. The tensioning elements can, in various embodiments, extend over any portion of the cambered arch region and can be shaped and configured to provide any degree and direction of support and elastic tensioning to any portion of the cambered arch region in a longitudinal, transverse, or intermediate direction. In the embodiment of FIGS. 5A to 5C the tensioning elements take the form of medial tensioning elements 320 extending between protruding elements 185 and over grooves 260 in a medial region of the arch and a lateral tensioning elements 325 extending between protruding elements 185 and over grooves 260 in a lateral region of the arch. Dividing the tensioning into a plurality of separate tensioning elements (e.g., 320, 325) allows the medial longitudinal cambered arch 305 and lateral longitudinal cambered arch 310 to be supported separately, thereby allowing for more controlled and adaptive support for the various regions of the foot throughout different footstrike events and for different users who may deform the arch differently based on their running style and foot geometry.

In one embodiment grooves, sipes, or other flexion supporting elements may be located in any appropriate region of the bottom 330, sides 335, and even top of the sole element. A plurality of side flexion grooves 340 are shown in FIGS. 5B and 5C. In an alternative embodiment any appropriate number, shape, and configuration of side flexion grooves may be utilized. In various embodiment tensioning elements may be located over any sipe, groove, and/or void within a sole element to provide elastic tensioning at any location, and in any direction(s), on the sole.

One embodiment of the invention may include cambered arches in other portions of the foot and or in other configurations, in addition to, or in place of longitudinal cambered arches in the midfoot region. In one embodiment, for example, a transverse arch region is located in a forefoot region of the sole to support and conformingly adapts to a deformation of the forefoot (for example a transverse flattening and splaying of the forefoot region at and around the metatarsal heads). An example sole element 300 having a transverse cambered arch 400 in a forefoot region 155, In addition to a longitudinal cambered arch system in the midfoot region 160, is shown in FIGS. 6A to 6F. In this embodiment, the forefoot region 155, as shown, for example, in Section B-B in FIG. 6D, has a transverse arch 400 having a cambered (i.e., curved) profile 405 when unloaded, the transverse arch 400 deflecting downwards 410 during loading (e.g., when the forefoot deforms towards a ground surface and elongates transversely) to conformingly flatten and splay along with the metatarsal head region of the foot.

Figure 8A:
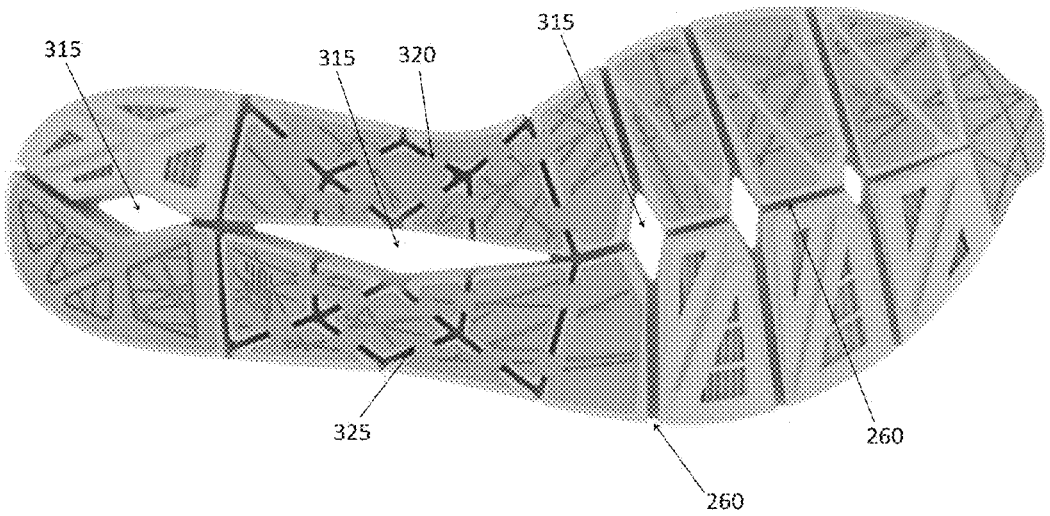
FIG. 8A is a bottom view of another sole for an article of footwear having a cambered longitudinal arch region, in accordance with one embodiment of the invention.
Figure 8B:
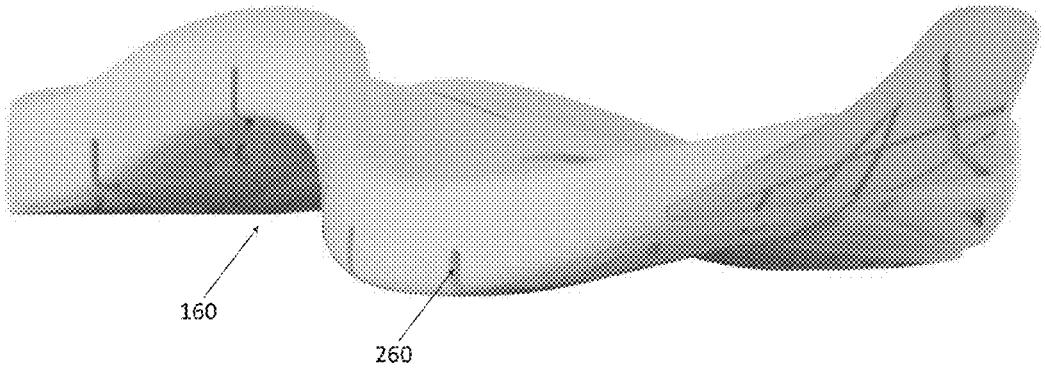
FIG. 8B is a perspective view of the sole of FIG. 8A.

The transverse arch 400 may be elastically supported by one or more transverse tensioning elements 415 that extend across longitudinal flex grooves 420 that are arranged longitudinally, or substantially longitudinally, on the underside of the sole element 300. The sole element 300 can also include transverse flex grooves 425 in the forefoot to provide additional flexibility on the forefoot region 155 (with, in some embodiment, longitudinally extending tensioning elements extending over the transverse flex grooves). The transverse cambered arch 400 can be configured to deflect in any appropriate manner and, for example, can be configured to deflect about an axis "A" extending along a central portion of the forefoot region 155. The axis "A" can be defined, for example, by the orientation and shape of the longitudinal flex grooves 190 in the forefoot region 155. The axis "A" may be at any acute angle to the longitudinal axis of the midfoot and heel regions (e.g., between 0° and 30°). Another example cambered sole element 300 is shown in FIGS. 8A and 8B.

Figure 7A:
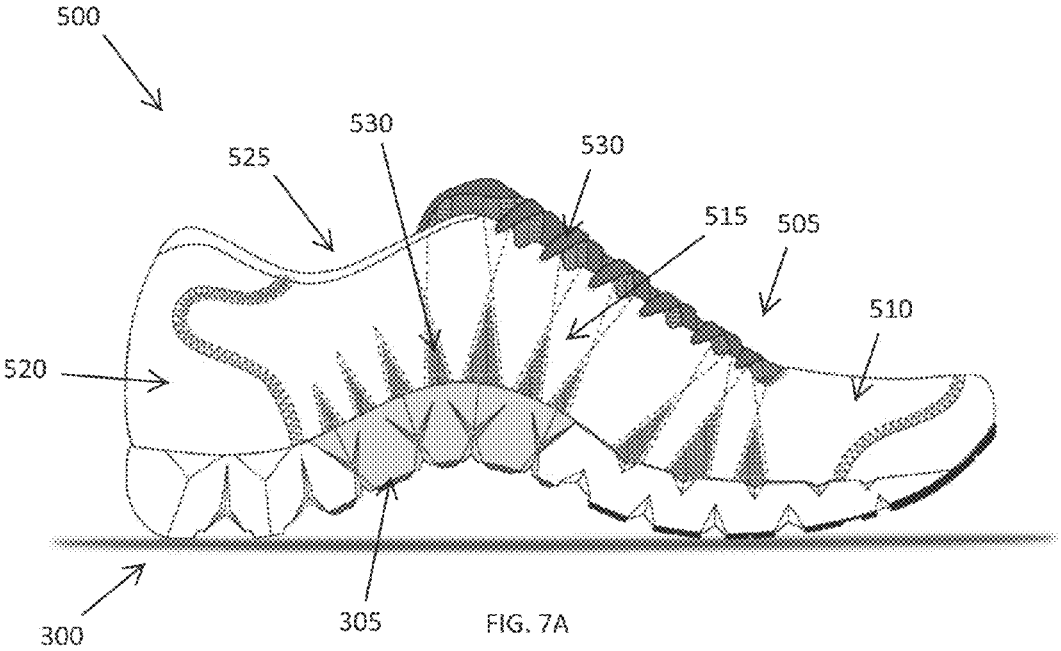
FIG. 7A is a medial side view of a medial side of an article of footwear having a cambered longitudinal arch region, in accordance with one embodiment of the invention.
Figure 7B:
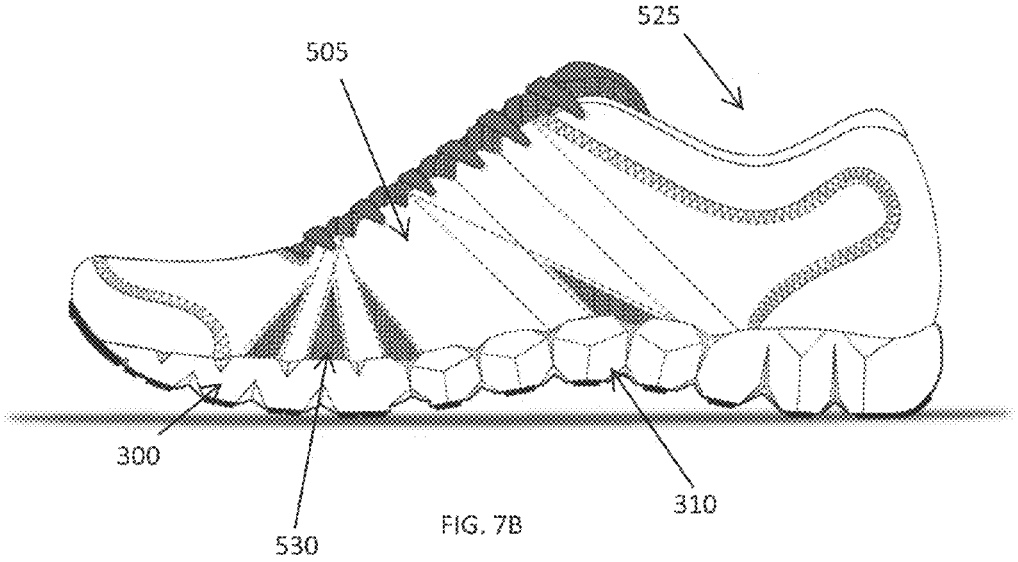
FIG. 7B is a lateral side view of a lateral side of the article of footwear of FIG. 7A.

A shoe 500 having a cambered sole element 300 is shown in FIGS. 7A and 7B. The shoe includes an upper 505 including a forefoot region 510, a midfoot region 515, and a heel region 520, and further includes an opening 525 for entry of the foot into an interior of the upper 505. The shoe 500 also includes a closing mechanism (e.g., a lacing system 530) for closing the upper and tightening the upper on the foot when worn. In an alternative embodiment any appropriate closing mechanism (e.g., hook and loop fastening, draw-string fastening, elastic element fastening, buckles, and the like) may be utilized.

In one embodiment the upper 505 can include one or more flexibility elements 530 (e.g., one or more elastically flexible and deformable portions) to allow the upper 505 to smoothly deform and elongate along with the sole element 300 during a loading event. For example, FIGS. 7A and 7B show an upper 505 having a plurality of elastic flexibility elements 530 (in this case triangular flexibility elements 530) formed from an elastically deformable material (e.g., a stretchable mesh) extending upwards from proximate the sole element 300 on both the medial and lateral side of the midfoot region 515 and forefoot region 510 (i.e., in the areas which will undergo the majority of the deformation during a loading event) to allow the upper 505 to deform easily during athletic activity in compliance with the deformation of the cambered sole element 300. In one embodiment the upper 505 may be formed from a deformable cage of flexible material providing structural stability to the upper with a plurality of flexible panels extending therebetween.

In one embodiment the sole may be formed from a plurality of separate portions, each of the portions attached to the upper and adapted to conformingly fit to the corresponding foot position while being able to flex and deform with respect to each other to allow for and support deformation and elongation of the foot during a loading event. In one embodiment the sole, or a portion thereof, can be formed from an accordion-like structure that allows for and supports the deformation and elongation of the sole during a loading event.

In various embodiments multiple elements of the foot can be configured to allow for, and support, vertical flexing of the various arch portions and longitudinal and transverse (and, where necessary, all angles in-between) elongation of the shoe (and especially the sole of the shoe) when loaded. For example, an insert for an interior of the shoe (e.g., an insole) may be formed from a flexible and stretchable material (e.g., a stretchable fabric and/or foam) to allow for deformation and elongation during loading.

It should be understood that alternative embodiments, and/or materials used in the construction of embodiments, or alternative embodiments, are applicable to all other embodiments described herein. The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. An article of footwear having a longitudinal axis and comprising:

an upper; and a sole comprising a midsole having a heel portion, a midfoot portion, and a forefoot portion, the midfoot portion comprising a substantially longitudinal arch comprising a medial longitudinal arch portion and a lateral longitudinal arch portion, wherein, in an unloaded condition, the longitudinal arch is at least partially elevated above a ground surface, such that the medial longitudinal arch portion extends to a greater height above the ground surface than the lateral longitudinal arch portion, and, in a loaded condition, deforms towards the ground surface and elongates longitudinally; and wherein a first plurality of protruding elements and at least one first tensioning element extending between discrete protruding elements of the first plurality are located within the medial longitudinal arch portion, so as to provide separate support thereto, and a second plurality of protruding elements and at least one second tensioning element extending between discrete protruding elements of the second plurality are located within the later longitudinal arch portion, so as to provide separate support thereto.

2. The article of footwear of claim 1, wherein the forefoot portion comprises a substantially transverse arch that, in the unloaded condition, is at least partially elevated above the ground surface and, in the loaded condition, deforms towards a ground surface and elongates transversely.

3. The article of footwear of claim 2, wherein the transverse arch is positioned proximate a metatarsal region of the forefoot portion.

4. The article of footwear of claim 2, wherein at least one of the medial longitudinal arch portion and the lateral longitudinal arch portion extends to a greater height than the transverse arch.

5. The article of footwear of claim 1, wherein the midsole comprises a plurality of flex grooves on a lower surface thereof.

6. The article of footwear of claim 5, wherein at least one flex groove extends in a substantially transverse direction and at least one flex groove extends in a substantially longitudinal direction.

7. The article of footwear of claim 5, wherein the flex grooves at least partially separate a lower surface of the midsole into the at least one first and second protruding elements located within the medial longitudinal arch portion and the lateral longitudinal arch portion, respectively.

8. The article of footwear of claim 7, further comprising a void between the first plurality of protruding elements on the medial longitudinal arch portion and the second plurality of protruding elements on the lateral longitudinal arch portion, wherein the void is wider than the flex grooves.

9. The article of footwear of claim 1, wherein the at least one first tensioning element on the medial longitudinal arch portion extends at an acute angle from the longitudinal axis.

10. The article of footwear of claim 1, wherein the at least one second tensioning element on the lateral longitudinal arch portion extends in a substantially longitudinal direction.

11. The article of footwear of claim 1, further comprising at least one tensioning element in the forefoot region.

12. The article of footwear of claim 11, wherein the at least one tensioning element in the forefoot region extends in a substantially transverse direction.

13. The article of footwear of claim 1, wherein the at least one tensioning element extends across at least one flex groove formed on a lower surface of the midsole.

14. The article of footwear of claim 9, wherein the at least one first tensioning element extends at an angle between about 10 degrees and about 40 degrees from the longitudinal axis.

15. The article of footwear of claim 1, wherein at least one of the first and the second tensioning elements comprises elastic elements.

16. The article of footwear of claim 1, wherein at least one of the first and the second tensioning elements, in the loaded condition, provide an elastic tension counteracting a deflection of the sole and, in the unloaded condition, assist in elastically returning the longitudinal arch of the sole to its unloaded shape.

17. A sole element for an article of footwear comprising:

a midsole having a heel portion, a midfoot portion, and a forefoot portion, the midfoot portion comprising a substantially longitudinal arch comprising a medial longitudinal arch portion and a lateral longitudinal arch portion, wherein, in an unloaded condition, the longitudinal arch is at least partially elevated above a ground surface, such that the medial longitudinal arch portion extends to a greater height above the ground surface than the lateral longitudinal arch portion, and in a loaded condition, deforms towards the ground surface and elongates longitudinally, and wherein a first plurality of protruding elements and at least one first tensioning element extending between discrete protruding elements of the first plurality are located within the media longitudinal arch portion, so as to provide separate support thereto, and a second plurality of protruding elements and at least one second tensioning element extending, between discrete protruding elements of the second plurality are located within the lateral longitudinal arch portion, so as to provide separate support thereto.

18. An article of footwear comprising:

an upper; and a sole comprising:

a midsole having a heel portion, a midfoot portion, and a forefoot portion, wherein:

(i) the midfoot portion comprises a substantially longitudinal arch comprising a medial longitudinal arch portion and a lateral longitudinal arch portion, wherein, in an unloaded condition, the longitudinal arch is at least partially elevated above a ground surface, such that the medial longitudinal arch portion extends to a greater height above the ground surface than the lateral longitudinal arch portion, and, in a loaded condition, deforms towards the ground surface and elongates longitudinally; and, wherein a first plurality of protruding elements and at least one first tensioning element extending between discrete protruding elements of the first plurality are located within the medial longitudinal arch portion, so as to provide separate support thereto, and a second plurality of protruding elements and at least one second tensioning element extending between discrete protruding elements of the second plurality are located within the lateral longitudinal arch portion, so as to provide separate support thereto;

(ii) the forefoot portion comprises a substantially transverse arch that, in an unloaded condition, is at least partially elevated above the ground surface and, in a loaded condition, deforms towards the ground surface and elongates transversely; and (iii) the midsole comprises a plurality of flex grooves on a lower surface thereof, the flex grooves at least partially separating a lower surface of the midsole into a plurality of protruding elements.

19. An article of footwear comprising:

an upper; and a sole comprising a midsole having a heel portion, a midfoot portion, and a forefoot portion and a plurality of flex grooves on a lower surface thereof, the midfoot portion comprising a substantially longitudinal arch comprising a medial longitudinal arch portion and a lateral longitudinal arch portion, such that the longitudinal arch, in an unloaded condition, is at least partially elevated above a ground surface and, in a loaded condition, deforms towards the ground surface and elongates longitudinally, wherein there are at least two protruding elements located within the medial longitudinal arch portion and at least two protruding elements located within the lateral longitudinal arch portion and a void is formed between at least one protruding element on the medial longitudinal arch portion and at least one protruding element on the lateral longitudinal arch portion, wherein the void is wider than the flex grooves, and wherein at least one tensioning element located within the medial longitudinal arch portion extends between discrete protruding elements, so as to provide separate support to the medial longitudinal arch portion, and at least one tensioning element located within the lateral longitudinal arch portion extends between discrete protruding elements, so as to provide separate support to the lateral longitudinal arch portion.

* * * * *